United States Patent [19]

Empson

[11] Patent Number: 4,460,099

[45] **Date of Patent: * Jul. 17, 1984**

[54] TELESCOPING UNCOUPLING LEVER FOR RAILWAY CAR COUPLERS

[75] Inventor: Kenneth G. Empson, Aurora, Ill.

[73] Assignee: Garbe Iron Works, Inc., Aurora, Ill.

[ * ] Notice: The portion of the term of this patent subsequent to Apr. 5, 2000 has been disclaimed.

[21] Appl. No.: 474,488

[22] Filed: Mar. 11, 1983

Related U.S. Application Data

[63] Continuation of Ser. No. 264,681, May 18, 1981, Pat. No. 4,378,890.

[51] Int. Cl.[3] ..... B61G 1/04; B61G 3/08; B61G 7/14

[52] U.S. Cl. ..... 213/159; 213/163; 213/166; 213/211; 213/219; 308/3 R; 403/109

[58] Field of Search ..... 213/159, 162, 163, 164, 213/165, 166, 211, 212, 213, 214, 215, 216, 217, 218, 219; 308/3, 3.8, 3 R; 384/299; 403/60, 80, 109

[56] References Cited

U.S. PATENT DOCUMENTS

| | | | |
|---|---|---|---|
| 2,885,095 | 5/1959 | Burke | 213/166 |
| 3,227,289 | 1/1966 | Cseri | 213/219 |
| 3,239,074 | 3/1966 | Boon et al. | 213/211 |
| 3,258,133 | 6/1966 | Hawkins | 213/219 |
| 3,438,513 | 4/1969 | Miller et al. | 213/166 |
| 3,814,267 | 6/1974 | Chierici | 213/166 |
| 3,834,554 | 9/1974 | Chierici | 213/166 |
| 3,904,254 | 9/1975 | Hagen et al. | 308/3.8 |
| 3,933,252 | 1/1976 | Murphy et al. | 213/166 |
| 4,010,854 | 3/1977 | Manyek | 213/166 |
| 4,054,337 | 10/1977 | Matt et al. | 384/299 |
| 4,378,890 | 4/1983 | Empson | 213/166 |

*Primary Examiner*—Howard Beltran

*Attorney, Agent, or Firm*—McDougall, Hersh & Scott

[57] ABSTRACT

Two side-by-side housings each receive a telescoping member therein. Bearings captivated within each housing engage the telescoping members such that the bearings are free to slide both with respect to the housings and the telescoping members. A handle for operating the lever and an arm for engaging the car coupler are mounted to opposing distal ends of the telescoping members. The other ends of the telescoping members are free to extend beyond the housings and have stops which abut the bearings while these ends are disposed within the housings.

5 Claims, 9 Drawing Figures

TELESCOPING UNCOUPLING LEVER FOR RAILWAY CAR COUPLERS

This application is a continuation of Ser. No. 264,681, filed May 18, 1981, now U.S. Pat. No. 4,378,890, issued Apr. 5, 1983.

BACKGROUND OF THE INVENTION

This invention relates generally to levers used for uncoupling railroad cars and more particularly to uncoupling levers of a telescoping type which extend and contract in response to movement of a cushioned railroad car coupler.

A railroad car uncoupling lever provides a manually operable means by which a person can uncouple adjacent railroad cars. One end of the uncoupling lever is connected to the car coupler mechanism and the other end of the lever, which includes a handle portion, is pivotally mounted by a bracket to the endsill of the railroad car. The simplest type of uncoupling lever consists of a steel rod bent into a particular configuration wherein one end of the rod hooks through an eye in the car coupler and the other handle end of the rod is pivotally mounted to a supporting bracket. However, such a simple lever is useful only when a constant distance exists between the coupler and the supporting bracket.

Cushioned railroad cars have couplers which are mounted on a center sliding sill which can move fore or aft as much as 20 inches in order to absorb buff and draft forces. In addition to the permissible fore and aft movement of the coupler, angular or side-to-side movement of up to 15 degrees from either side of a longitudinal center line may occur. This, of course, means that an uncoupling lever for such a car must be capable of extending and contracting as the distance between the coupler and the supporting bracket increases and decreases. The supporting bracket, which pivotally anchors one end of the uncoupling lever, may be mounted at various locations along the endsill of the car. This increases the range of distances over which an uncoupling lever must be capable of telescoping. When worst case conditions are taken into account, a telescoping uncoupling lever must be capable of substantial contraction and extension, viz. over the approximate range of 37 inches to 84 inches.

Various types of telescoping uncoupler assemblies have been developed. For example, U.S. Pat. Nos. 3,227,289 to Cseri, 3,258,133 to Hawkins, and 3,438,513 to Miller all disclose an outer tubular member having mounted to one end thereof a handle pivotally secured to the endsill of a railroad car. The other end of the outer tubular member slidably receives a smaller longitudinal member which is in turn connected either directly or indirectly to a railroad car coupler thereby defining a telescoping uncoupler assembly.

U.S. Pat. Nos. 3,239,074 to Boone and 3,814,267 to Chierici disclose telescoping uncoupling levers which more closely resemble the present invention in that each includes a longitudinal housing having two chambers which telescopingly receive two arms. The distal end of one of the arms has mounted thereto a handle pivotally carried by a bracket on the endsill of the car and the distal end of the other arm is connected to the railroad car coupler. Blocks or shoes are attached to the proximal ends of the arms for guiding the arms within the housing.

Although such telescoping uncoupling levers have solved some of the problems which such levers encounter, certain problems still remain. It is difficult if not impossible for such levers to accommodate the substantial range of distances over which an uncoupling lever must be capable of telescoping when worst case conditions are taken into account. The design of telescoping levers is further complicated because railroad operating conditions impose further restraints; for example, the necessity of designing a lever so that (a) a missed coupling impact will not damage the lever, and (b) clearance restrictions are not violated. If a telescoping uncoupling lever is subjected to a distance beyond its operating range, the tremendous forces transmitted to such a lever permanently deforms it rendering it inoperable.

Because of the way in which the sliding and stationary members of conventional telescoping uncouplers cooperate, it is possible for such a coupler to "lock-up" even though the operating range of the coupler has not been exceeded. This lock-up problem typically occurs at the beginning of a contraction after the coupler has been extended to near its maximum extended range. During this condition, there is a minimum of overlap between the sliding and stationary members in the telescoping section resulting in maximum axial misalignment between such members. Such misalignment tends to cause a binding frictional force between the sliding and stationary members which if sufficiently great prevents the movable members from sliding axially with respect to the fixed members, and the lever locks up or freezes causing the lever to be deformed by the compression forces. The present invention provides a solution to the lock-up problem and to the inability of levers to operate over the full range of distances encountered in worst case conditions.

SUMMARY OF THE INVENTION

The present invention provides two side-by-side housings which are fixedly mounted to each other and which each receive a longitudinal member which telescopes within the housings. Each housing includes a bearing which preferably consists of a plurality of plastic bearing sleeves disposed between the telescoping members and the housing. The bearings are captivated within the housing and are free to slide both with respect to the housing and with respect to the telescoping members. The distal ends of the telescoping members have mounted respectively thereto a handle member which is pivotally connected to a support bracket and a coupling arm which is connected to the coupler. The proximal ends of the telescoping members have a stop mounted thereto to prevent the bearings from sliding off such ends while disposed within the housing. Preferably these stops are made of a plastic material and also serve as bearings. The housing is provided with structure for guiding these stops into the housing; this structure may consist of an outwardly sloping ramp formed by a wall of the housing.

An object of the present invention is to provide a telescoping uncoupling lever which is operable over a large range of distances.

Another object of the present invention is to provide an improved telescoping uncoupling lever which has a reduced tendency to lock up.

A further object of the present invention is to provide structure for expelling foreign matter such as sand from such an uncoupling lever.

DETAILED DESCRIPTION OF THE PRESENT INVENTION

Figure 1:
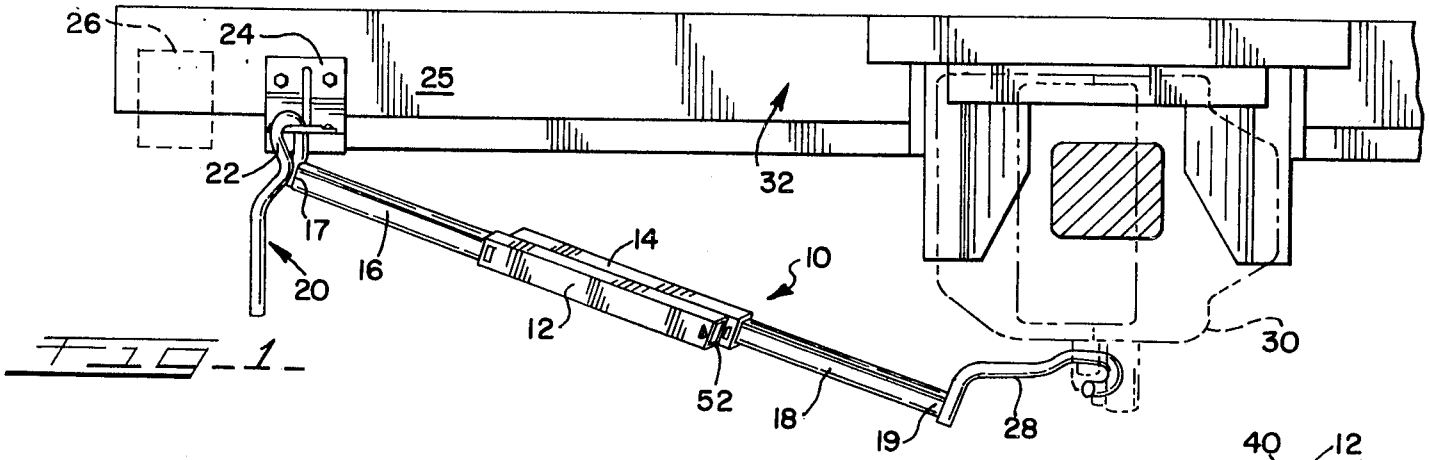
FIG. 1 is a perspective view of an embodiment of the present invention in operative relationship with a railroad car.

Referring in particular to FIG. 1, an improved telescoping uncoupling lever 10 includes fore and aft housings 12 and 14 which receive fore and aft telescoping members 16 and 18, respectively. The distal end 17 of the fore telescoping member 16 has mounted thereto a conventional handle member 20 which is typically formed from steel rod and includes a handle portion 22 that is pivotally carried by railroad car supporting bracket 24. The supporting bracket can be mounted over a range of locations between an inner position as shown in FIG. 1 and an outer position 26 shown in dotted lines to the endsill 25 of a railroad car 32. The distal end 19 of aft telescoping member 18 has mounted thereto a conventional coupler arm 28 typically made from steel rod which pivotally engages coupler 30. The lifting of handle 20 produces substantially axial rotation about the general longitudinal axis of uncoupling lever 10 so as to transmit such rotation to coupler arm 28 to unlock coupler 30 of railroad car 32 from an adjacent railroad car (not shown). If railroad car 32 is a so-called "cushioned" railroad car having a moving center sill, coupler 30 can move fore and aft as much as twenty inches and from side to side within a thirty degree arc. Because the uncoupling lever 10 is always connected between the supporting bracket and the coupler, the lever must be capable of extending and contracting over a considerable distance to accommodate the coupler movement.

Figure 2:
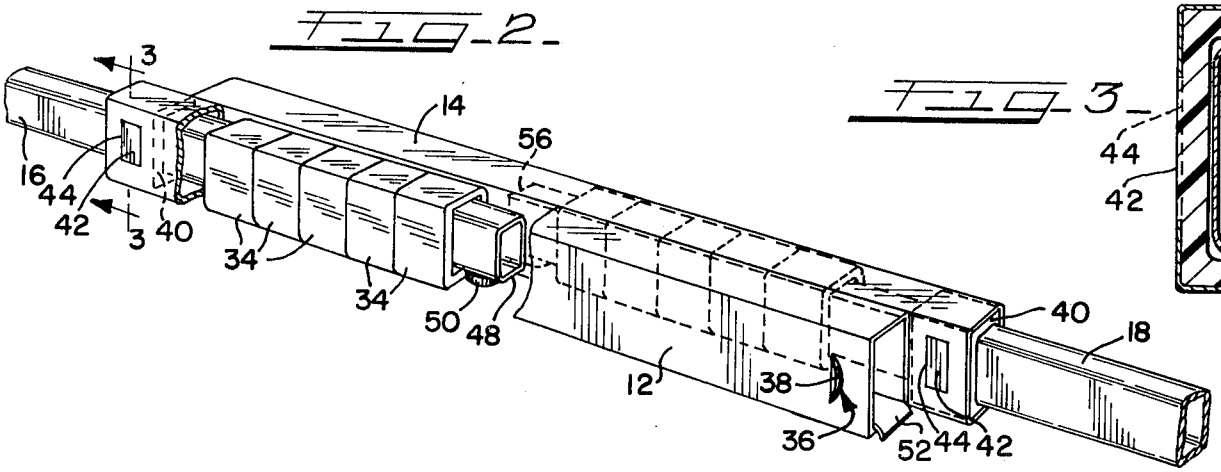
FIG. 2 is a partial perspective view of a first embodiment of the present invention with a portion of a housing shown cut away.

Now referring in particular to FIG. 2, details of the fore and aft housings and their mating telescoping members are shown. The two housings are fixedly mounted with respect to each other and have a polygonal cross-sectional configuration. The preferred cross-sectional configuration of the housing is rectangular having the longer sides in a substantially horizontal plane when the coupling lever is operatively mounted. (See FIG. 1.) The housings are preferably constructed from two separate sheets of steel formed into the desired configuration and welded together in a parallel side-by-side configuration. However, the housing could comprise a single tubular member separated into two compartments by a partition wall. The telescoping members 16 and 18 preferably have a generally complementary cross-sectional configuration to the housings and are preferably constructed from tubular steel.

Bearings are disposed in each of the housings to slidably support the telescoping members. In the embodiment, as shown in FIG. 2, a plurality of bearing sleeves 34 function to carry telescoping member 16 within the housing 12. Bearing sleeves 34 are preferably made from a plastic material such as that sold under the trademark Delrin. The bearing sleeves may be constructed to have a nominal clearance between the inside wall surfaces of the bearing and the outside of the telescoping members and between the outside wall surfaces of the bearing and the inside of the housing so that the bearings can slide within the housing and along the telescoping members. Alternatively, the bearings can be dimensioned to apply a continuous slight inward pressure against the telescoping members so the bearings will slide with the latter until abutting a stop at either end of the housing wherein the telescoping members will slide within the bearings.

Figures 4, 5, 6, 7, 8:
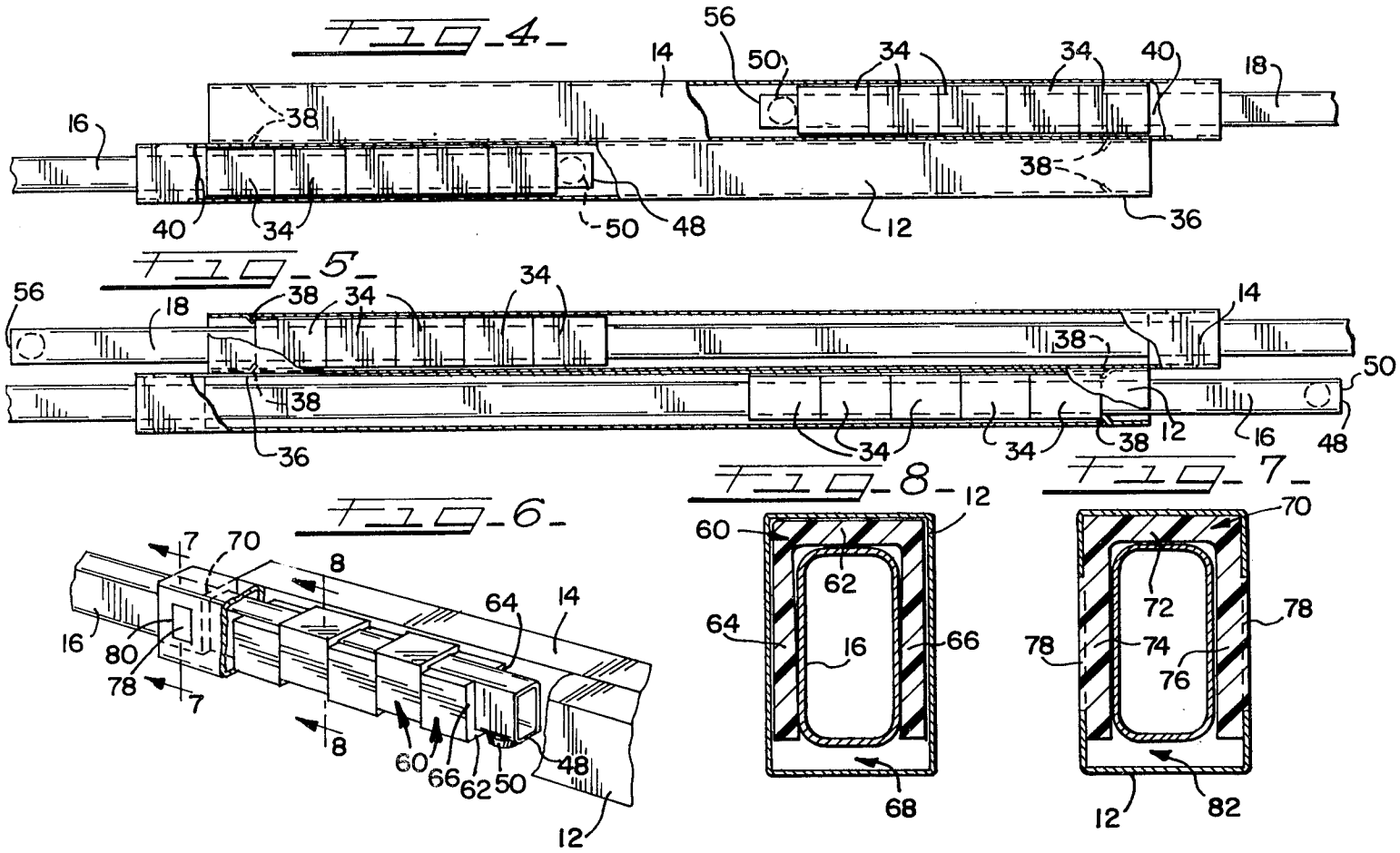
FIG. 4 is a partial top view of the first embodiment with portions of the housing cut away to illustrate the uncoupling lever in a maximum extended condition.
FIG. 5 is similar to FIG. 4 except that the uncoupling lever is shown in an intermediate position between maximum extension and contraction.
FIG. 6 is a fragmentary perspective view of a second embodiment of the present invention in maximum extension.
FIG. 7 is a cross-sectional view taken about line 7—7 in FIG. 6.
FIG. 8 is a cross-sectional view taken about line 8—8 in FIG. 6.

The bearings are captivated at each end of the housings by means of stops. As seen in FIGS. 2, 4 and 5, the right end of housing 12 contains stops 36 formed by inwardly stamping sections of the two vertical walls of housing 12 to form a portion 38 which protrudes or projects inwardly so as to abut the edge of the rightmost sleeve bearing 34 (see FIG. 5) without interfering with the movement of telescoping member 16. Thus stops 36 serve to prevent the bearings from exiting the right-hand end of housing 12. This same type of stop is utilized for the left end of housing 14.

Figure 3:
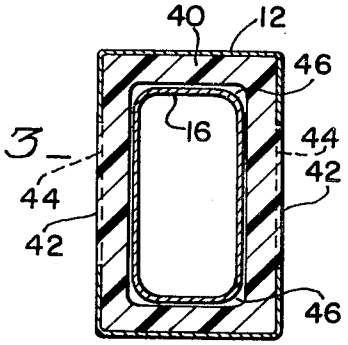
FIG. 3 is a cross-sectional view taken about line 3—3 in FIG. 2.

As seen in FIGS. 2 and 3, stopping sleeve 40 is fixedly mounted to the right end of housing 14 and to the left end of housing 12. Preferably a pair of projections 42 extend from opposite outer walls of the stopping sleeve and mate with corresponding apertures 44 in the walls of housing sleeve 14. The stopping sleeve 40 is preferably made from the same material used for the bearing sleeves 34 and may be inserted into the housing by compressing the resilient side walls which contain the protrusions 42 allowing the stop to enter the housing. Thereafter, the compressed side walls are released permitting the stopping sleeve to flex back to its original shape thereby forcing the protrusions 42 through apertures 44, locking the stop into place as illustrated in FIG. 2. Housings 12 and 14 are preferably longitudinally offset to permit the visual examination of both protrusions 42. While the offset of the housing as shown in FIG. 2 represents the preferred construction, using a greater offset or no offset could be employed since protrusions 42 need not extend beyond the walls of the housing.

FIG. 3 is a cross-sectional view illustrating the stopping sleeve as locked to the housing. It will be observed from FIG. 3 that the external corners of telescoping member 16 may have a relatively large radius (relatively rounded corners) as opposed to the adjacent inside corners of stop 40 which have a smaller radius or are less rounded to define spaces 46. These spaces provide an exit path from the lever for small foreign material such as grains of sand or water. The relationship between the interior perimeter of bearing sleeves 34 and the telescoping members may be similar to that illustrated in FIG. 3 relative to stop 40. The exterior perimeter of bearing sleeves 34 have a nominal clearance with respect to the interior perimeter of the housing to permit the bearings 34 to slide within the housing unlike the fixed stopping sleeve 40.

As shown in FIG. 2, the proximal end 48 of telescoping member 16 has an abutment or stop 50 mounted to the lower wall adjacent end 48. This abutment prevents bearing sleeves 34 from exiting proximal end 48 while the telescoping member 16 is within housing 12. Preferably, stop 50 extends from the telescoping member by a distance substantially equal to the corresponding wall thickness of bearing sleeves 34 and is desirably made from a plastic bearing material so as to also function as a fixed end bearing for telescoping member 16. An identical abutment is similarly mounted adjacent proximal end 56 on telescoping member 18.

The tendency of the proximal ends of the telescoping members, when the lever 10 is installed, is to extend downwardly. Thus, the bottom end walls of the housing would tend to abut, i.e. interfere, with stops 50 as the proximal ends of the telescoping members attempted to enter the housing ends. To overcome this problem the bottom wall of the right end of housing 12 is bent outwardly so as to provide a gradually sloping ramp 52 which provides a way for guiding the stop 50 of telescoping member 16 into the housing. A similar ramp is provided at the left end of housing 14. Preferably, stops 50 have tapered or rounded edges which cooperate with ramps 52 to provide a smooth entry of the proximal ends of telescoping members into the ends of housings. It will be understood that in general the telescoping members and housings are substantially identical in design but disposed in opposite directions.

Now referring to FIGS. 4 and 5, the telescoping uncoupling lever 10 is illustrated in various positions of extension and contraction. FIG. 4 illustrates a maximum extension of telescoping members 16 and 18 outwardly away from the housings. In this position, the bearing sleeves 34 are contiguous with each other; the outer bearing sleeves abut stops 40; and the inner bearing sleeves are abutted by stops 50 of the telescoping members.

FIG. 5 represents an intermediate position of the telescoping members in which their proximal ends 48 and 56 extend substantially beyond the housings. The outermost bearing sleeves 34 are shown abutting projections 38 of stops 36. Telescoping element 16 is free to continue moving to the right, i.e. contract, through housing 12 until handle member 20 (see FIG. 1) which is mounted to distal end 17 abuts the left end of housing 12. Similarly, telescoping member 18 is free to move to the left through housing 14 until the end of coupler arm 28 which is mounted to distal end 19 abuts the right end of housing 14.

FIGS. 6, 7 and 8 illustrate a second modified embodiment of the present invention in which bearing sleeves 60 having a U-shaped cross-section are utilized. Bearing sleeves 60 are slidable with respect to the telescoping members and with respect to the housings similar to bearings 34 and may be made from like material. Each of bearings 60 include a web 62 and flanges 64 and 66 which are substantially perpendicular to the web. Preferably the flanges are dimensioned to provide a slight inward pressure against the telescoping members so that bearings 60 will tend to slide with the latter within the housing.

The bearings are captivated within the housing 12 by stop sleeve 70 and stop 36 (not shown in FIG. 6). Stop sleeve 70 comprises a web 72 and flanges 74 and 76 each including a protrusion 78 dimensioned to be received by apertures 80 in housing 12. A space 82 opposite web 72 is adjacent the bottom wall of housing 12 at its left end.

The bearing sleeves 60 are desirably arranged, as shown in FIG. 6, in an alternating sequence with webs 62 alternately facing opposite directions. This arrangement creates alternating spaces 68 which provide a path through which foreign matter, such as sand, can pass by traveling from space to space as the bearings move back and forth. Foreign matter can exit the left end of housing 12 via space 82 or the open right end of the housing. Thus, sand does not become trapped between the bearings and the housing to cause excessive wear or increased frictional forces which could cause the lever to lock up. It will be apparent that a similar arrangement can be used in housing 14.

Figure 9:
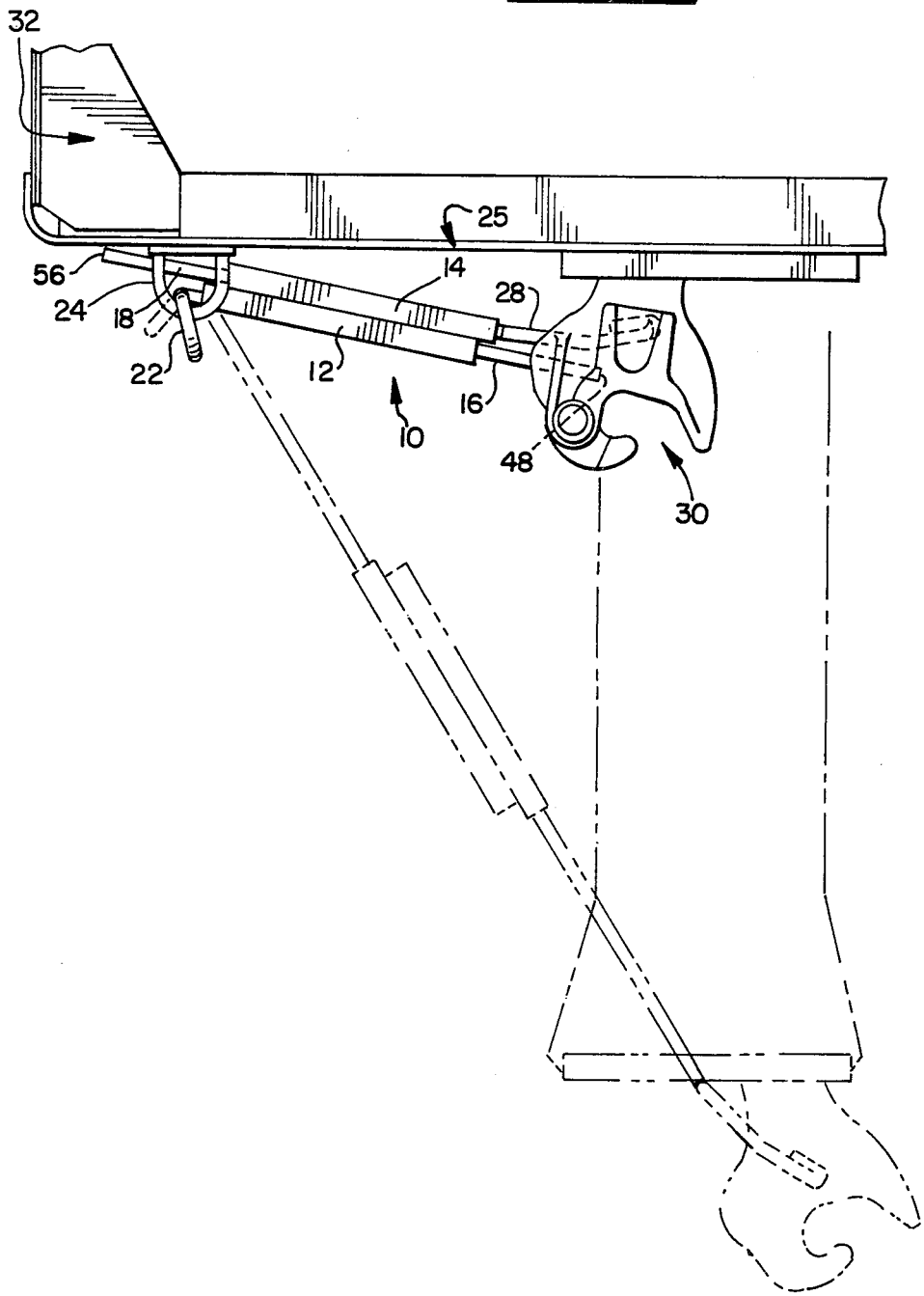
FIG. 9 is a top view illustrating the uncoupling lever of the present invention in operative engagement with a railroad car showing the lever in maximum contraction in solid lines and maximum extension in broken lines.

FIG. 9 illustrates uncoupling lever 10 in maximum contraction and extension. As shown in contraction, proximal ends 48 and 56 of telescoping members 16 and 18 extend substantially beyond the housings. This allows the uncoupling lever of the present invention to achieve a larger operational range than other generally similar levers such as previously noted U.S. Pat. Nos. 3,239,074 and 3,814,267 which are restricted by design limitations in the ability to contract.

The following dimensions are provided as a specific example of a lever constructed in accordance with the present invention which can operate over the range of 36 inches to 85 inches. The housings 12 and 14 are each 22 inches long and are offset by 1½ inches. The telescoping members 16 and 18 are 30 inches and 33½ inches long, respectively. Coupling arm 28 may be constructed generally in accordance with those known in the art and may be approximately 11 inches from the bend adjacent end 19 to the center of the hook eye for engaging the coupler. It will be apparent to those skilled in the art in light of this teaching that the above dimensions can be altered to accommodate different contraction and extension limits and other ranges.

One advantage of the present invention is that it has a wide operating range, which is enhanced by the ability to accommodate short distances between a coupler and supporting bracket, i.e. contraction. Another advantage of the present invention is that levers constructed in accordance therewith are unlikely to lock up. For a lever constructed in accordance with the present invention to lock up, the bearing sleeve would have to become frozen with respect to the housing and the telescoping member become frozen with respect to the bearing sleeve. It is very unlikely that both such conditions would occur simultaneously. A further advantage of the present invention is that foreign matter such as sand is not trapped within the lever to cause excessive wear or friction because an escape path is provided.

It will be apparent to those skilled in the art that various alterations and modifications can be made to the embodiments of the present invention as illustrated herein. For example, although the housings, bearing sleeves, and telescoping members preferably have a rectangular cross-sectional configuration, various other geometrical shapes could be employed, as well as any type of keyed design which would facilitate the transmission of longitudinal axial rotation from a handle member to the railroad coupler. A single slidable bearing could be substituted for the plurality of sleeve bearings disclosed herein.

While the present invention has been described above and illustrated in the accompanying drawings, it will be understood that the scope of the present invention is defined by the claims appended hereto.

I claim:

1. An improved telescoping uncoupling lever for uncoupling railroad cars having a coupler and support bracket mounted to the end sill thereof, with the lever including first and second longitudinal tubular metallic housings in fixed together, parallel, side-by-side, relation defining a housing assembly having a first end at one end of the housing assembly and a second end at the other end of the housing assembly, a first elongate rectilinear telescoping metallic member slidably received in the first housing from said one end of said housing assembly in torque transmitting relation thereto and having a distal end and a proximal end, a second elongate rectilinear telescoping metallic member slidably received in the second housing from said other end of said housing assembly in torque transmitting relation thereto and having a distal end and a proximal end, a handle member connected to the distal end of said first telescoping member including a handle portion for being pivotally supported by said support bracket, and an uncoupling arm connected to the distal end of said second telescoping member for engaging said coupler, the improvement comprising:

a first stopping sleeve disposed between said first telescoping member and said first housing adjacent and within said one end of said housing assembly in embracing relation to said first telescoping member, said first stopping sleeve including a first locking element that mates with a second locking element in the wall of said first housing for locking said first stopping sleeve to said first housing within same, a second stopping sleeve disposed between said second telescoping member and said second housing adjacent and within said other end of said housing assembly in embracing relation to said second telescoping member, said second stopping sleeve including a first locking element that mates with a second locking element in the wall of said second housing for locking said second stopping sleeve to said second housing within same, said stopping sleeves each being of one piece construction formed from a plastic bearing material, a first end abutment member keyed to said first telescoping member adjacent the proximal end of same and disposed between said first telescoping member proximal end and the underside of said first housing in sliding relation to said first housing, a second end abutment member keyed to said second telescoping member adjacent the proximal end of same and disposed between said second telescoping member proximal end and the underside of said second housing in sliding relation to said second housing, said abutment members each being of one piece construction formed from a plastic bearing material, first slide bearing means interposed between said first telescoping member and said first housing and within said first housing in embracing relation to said first telescoping member for maintaining said first telescoping member adjacent said proximal end thereof in said torque transmitting relation with respect to said first housing, and second slide bearing means disposed between said second telescoping member and said second housing and within said second housing in embracing relation to said second telescoping member for maintaining said second telescoping member adjacent said proximal end thereof in said torque transmitting relation with respect to said second housing, with said slide bearing means being defined by plastic bearing material, said first housing adjacent said other end of said housing assembly defining internal stop means positioned for stopping engagement with said first slide bearing means for maintaining same within said first housing, and said second housing adjacent said one end of said housing assembly defining internal stop means positioned for stopping engagement with said second slide bearing means for maintaining same within said second housing.

2. The improvement according to claim 1 wherein:

each first locking element is in the form of a protrusion and each second locking element is in the form of an aperture.

3. The improvement set forth in claim 1 wherein:

said stopping sleeves, said telescoping members, said housings, and said slide bearing means are formed to define a path means for passage therethrough of foreign matter from within the respective housings outwardly of said ends of said housing assembly.

4. The improvement set forth in claim 3 wherein:

said stopping sleeves are sleeve bearings that respectively encompass the respective telescoping members they cooperate with.

5. The improvement set forth in claim 3 wherein:

said stopping sleeves are of generally U-shaped transverse cross-sectional configuration with the open sides of same being adjacent the undersides of the respective housings for defining said path means at the underside of the respective housings.

* * * * *